US007297382B2

(12) United States Patent
Van Aert et al.

(10) Patent No.: US 7,297,382 B2
(45) Date of Patent: Nov. 20, 2007

(54) INK-JET RECORDING MATERIAL

(75) Inventors: Hubertus Van Aert, Pulderbos (BE); Johan Loccufier, Zwijnaarde (BE); Stefaan Lingier, Assenede (BE)

(73) Assignee: AGFA-Gevaert, Mortsel (BE)

( * ) Notice: Subject to any disclaimer, the term of this patent is extended or adjusted under 35 U.S.C. 154(b) by 165 days.

(21) Appl. No.: 10/701,701

(22) Filed: Nov. 5, 2003

(65) Prior Publication Data

US 2004/0121094 A1 Jun. 24, 2004

Related U.S. Application Data

(60) Provisional application No. 60/428,864, filed on Nov. 25, 2002.

(30) Foreign Application Priority Data

Nov. 18, 2002 (EP) ..... 02102602

(51) Int. Cl.
*B41M 5/50* (2006.01)

(52) U.S. Cl. ..... 428/32.26; 428/32.1; 428/32.34

(58) Field of Classification Search ..... None
See application file for complete search history.

(56) References Cited

U.S. PATENT DOCUMENTS

| | | | | |
|---|---|---|---|---|
| 4,877,686 | A | 10/1989 | Riou et al. | 428/514 |
| 6,838,135 | B2 * | 1/2005 | Kasahara | 428/32.31 |
| 2001/0014381 | A1 | 8/2001 | Kaneko et al. | 428/195 |
| 2003/0059599 | A1 * | 3/2003 | Beckley et al. | 428/327 |

FOREIGN PATENT DOCUMENTS

| | | |
|---|---|---|
| EP | 0 888 904 | 1/1999 |

* cited by examiner

*Primary Examiner*—Bruce H. Hess
(74) *Attorney, Agent, or Firm*—Joseph T. Guy; Nexsen Pruet, LLC

(57) ABSTRACT

An improved ink-jet recording material is disclosed comprising a support and at least one ink receiving layer containing a water-soluble or water-dispersible polymer, characterized in that said polymer comprises a repeating monomeric unit having a moiety capable of chelating boric acid by means of at least one nitrogen containing functional group and at least one hydroxyl group thereby forming a five- or six-membered ring.

32 Claims, No Drawings

INK-JET RECORDING MATERIAL

CROSS-REFERENCE TO RELATED PATENT APPLICATIONS

This application claims the benefit of U.S. Provisional Application No. 60/428,864 filed Nov. 25, 2002, which is incorporated by reference. In addition, this application claims the benefit of European Application No. 02102602.6 filed Nov. 18, 2002, which is also incorporated by reference.

FIELD OF THE INVENTION

The present invention relates to an improved ink-jet recording material.

BACKGROUND OF THE INVENTION

In the majority of applications printing proceeds by pressure contact of an ink-loaded printing form with an ink-receiving material which is usually plain paper. The most frequently used impact printing technique is known as lithographic printing based on the selective acceptance of oleophilic ink on a suitable receptor. In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink-jet printing has become a popular technique because of its simplicity, convenience and low cost. Especially in those instances where a limited edition of the printed matter is needed ink-jet printing has become a technology of choice. A recent survey on progress and trends in ink-jet printing technology is given by Hue P. Le in *Journal of Imaging Science and Technology* Vol. 42 (1), January/February 1998.

In ink-jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink-jet printers include U.S. Pat. Nos. 3,739,393, 3,805,273 and 3,891,121.

The jetting of the ink droplets can be performed in several different ways. In a first type of process a continuous droplet stream is created by applying a pressure wave pattern. This process is known as continuous ink-jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink-jet printing several jets are deflected to a different degree and thus record the image (multideflection system). According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink-jet typically include following ingredients: dyes or pigments, water and/or organic solvents, humectants such as glycols, detergents, thickeners, polymeric binders, preservatives, etc. It will be readily understood that the optimal composition of such an ink is dependent on the ink-jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves primarely evaporation;
- hot melt or phase change: the ink vehicle is liquid at the ejection temperature but solid at room temperature; drying is replaced by solidification;
- UV-curable; drying is replaced by polymerization.

U.S. Pat. No. 4,877,686 discloses a recording sheet for use in connection with inkjet printing comprising an opaque base sheet and a surface coating on said base sheet, said surface coating comprising a polyhydroxylic polymeric binder with the hydroxyl groups in the cis position, a substantial portion of said binder having been gelled with a gelling agent selected from the group consisting of boric acid, derivatives of boric acid, and mixtures thereof, and a filler component having high absorption capacity, said binder being present in an amount of from about 10 to 100 percent by weight of the amount of said filler, whereby said filler primarily acts as the ink receptor in said ink-jet printing and the shape, size and uniformity of dots of said ink as applied to said recording sheet may be substantially improved thereby.

US 2001/014381 A1 discloses an ink-jet recording material comprising a support, and an ink-receptive layer containing fumed silica having an average primary particle size of 3 nm to 30 nm provided on the support, wherein said ink-receptive layer contains a cationic compound and at least one compound selected from the group consisting of a sulfur-containing compound having no mercapto group, an amine compound, an amino compound and a saccharide, and a pH of the surface of the ink-jet recording material is 3 to 6.

EP 888,904 A1 discloses an ink-jet recording method comprising: recording on an ink-jet recording sheet comprising a non-water-absorbing support and provided thereon an ink absorbing layer containing polyvinyl alcohol, fine inorganic particles and boric acid or its salt, using an ink-jet recording apparatus and a water-based recording liquid containing a high boiling solvent containing a hydroxy group, wherein the following requirements (1) and (2) are met: (1) $0.05 \leqq X/Y \leqq 0.5$ and (2) $Z/Y \leqq 4$, wherein X is an amount of boric acid or its salt contained in the ink absorbing layer of the recording sheet, expressed in mmol/m; Y is an amount of a hydroxy group contained in polyvinyl alcohol contained in the ink absorbing layer of the recording sheet, expressed in mmol/m; and Z is a maximum amount of the hydroxy group contained in the high boiling solvent contained in a unit area when recorded on the recording sheet at a maximum ejecting amount of the water-based recording liquid, expressed in $mmol/m^2$.

It is known that the ink-receiving layers in ink-jet recording materials must meet different stringent requirements:

- the ink-receiving layer should have a high ink absorbing capacity, so that the dots will not flow out and will not be expanded more than is necessary to obtain a high optical density;

the ink-receiving layer should have a high ink absorbing speed (short ink drying time) so that the ink droplets will not feather if smeared immediately after applying;

the ink dots that are applied to the ink-receiving layer should be substantially round in shape and smooth at their peripheries. The dot diameter must be constant and accurately controlled;

the receiving layer must be readily wetted so that there is no "puddling", i.e. coalescence of adjacent ink dots, and an earlier absorbed ink drop should not show any "bleeding", i.e. overlap with neighbouring or later placed dots;

transparent ink-jet recording elements must have a low haze-value and be excellent in transmittance properties;

after being printed the image must have a good resistance regarding water-fastness, light-fastness, and good endurance under severe conditions of temperature and humidity;

the ink-jet recording element may not show any curl or sticky behaviour if stacked before or after being printed; and the ink-jet recording element must be able to move smoothly through different types of printers.

All these properties are often in a relation of trade-off. It is difficult to satisfy them all at the same time.

In order to obtain images showing high gloss, high color densities and fast drying it is desirable that the ink receiving layer has a relative high coating weight and a high pigment/binder ratio. However, such a high pigment/binder ratio tends to deteriorate the mechanical strength of the ink receiving layer, in particular when a flexible support is used, which is often visible as microcracks. It is strongly desired to find measures to avoid this cracking while retaining the other good image properties.

OBJECTS OF THE INVENTION

It is an object of the present invention to provide an ink-jet recording material capable of providing a finished image exhibiting high gloss and high densities in the absence of cracking.

Further objects and advantages of the invention will become apparent from the description hereinafter.

SUMMARY OF THE INVENTION

It has been surprisingly found that a finished image exhibiting high gloss and high densities in the absence of cracking can be realized by using an ink-jet recording material comprising a polymer containing a repeating monomeric unit having a moiety capable of chelating boric acid by means of at least one nitrogen containing functional group and at least one hydroxyl group thereby forming a five- or six-membered ring together with boric acid. Crosslinking of the above-mentioned polymer can be realized with crosslinking agent in the ink-jet recording material or applied to the ink-jet recording material for example with the ink-jet ink.

According to the present invention an ink-jet recording material is provided comprising a support and at least one ink receiving layer containing a water-soluble or water-dispersible polymer, characterized in that said polymer comprises a repeating monomeric unit having a moiety capable of chelating boric acid by means of at least one nitrogen containing functional group and at least one hydroxyl group thereby forming a five- or six-membered ring.

Further advantages and embodiments of the present invention will become apparent from the following description.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The term saturated aliphatic group as used in disclosing the present invention means saturated straight chain, branched chain and alicyclic hydrocarbon groups.

The term unsaturated aliphatic group as used in disclosing the present invention means straight chain, branched chain and alicyclic hydrocarbon groups which contain at least one double or triple bond.

The term aryl group as used in disclosing the present invention means an assemblage of cyclic conjugated carbon atoms, which are characterized by large resonance energies, e.g. benzene, naphthalene and anthracene.

The term heteroaryl group as used in disclosing this invention means an aryl group wherein one or more carbon atoms of said assemblage of cyclic conjugated carbon atoms of said aryl group are replaced by an atom selected from the group of oxygen, nitrogen, sulfur, selenium and tellurium.

The term substituted as used in disclosing this invention means that one or more of the carbon atoms and/or that a hydrogen atom of one or more of carbon atoms in an aliphatic group, an aryl group or a heteroaryl group, are replaced by an oxygen atom, a nitrogen atom, a sulfur atom, a selenium atom or a tellurium atom, or a group containing one or more of these said carbon and hydrogen replacing atoms. Such substituents include hydroxyl groups, ether groups, carboxylic acid groups, ester groups, amide groups and amine groups.

Support

The support for use in the present invention can be chosen from paper type and polymeric type supports well-known from photographic technology. Paper types include plain paper, cast coated paper, polyethylene coated paper and polypropylene coated paper. Polymeric supports include cellulose acetate propionate or cellulose acetate butyrate, polyesters such as polyethylene terephthalate and polyethylene naphthalate, polyamides, polycarbonates, polyimides, polyolefins, poly(vinylacetals), polyvinyl chloride, polyethers and polysulfonamides. Other examples of useful high-quality polymeric supports for the present invention include opaque white polyesters and extrusion blends of polyethylene terephthalate and polypropylene. Polyester film supports and especially polyethylene terephthalate are preferred because of their excellent properties of dimensional stability. When such a polyester is used as the support material, a subbing layer may be employed to improve the bonding of the ink-receiving layer to the support. Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

Ink Receiving Layer

The ink receiving layer may be just a single layer but, alternatively, it may be composed of a double layer or even of a multiple layer assemblage.

The ink-receiving layer or at least one of the ink-receiving layers, in the case of multiple layers, according to the present invention, may further contain a pigment.

The ink-receiving layer or in at least one of the ink-receiving layers, in the case of multiple layers, according to the present invention, may also further contain a cationic substance acting as mordant.

The ink-receiving layer(s), and optional auxiliary layer(s), such as a backing layer for anti-curl purposes, may further contain well-known conventional ingredients, such as surfactants serving as coating aids, hardening agents, plasticizers, light-stabilizers, whitening agents and matting agents.

The ink-receiving layer and the optional auxiliary layer(s) may also be crosslinked to provide such desired features as waterfastness and non-blocking characteristics. The crosslinking is also useful in providing abrasion resistance and resistance to the formation of fingerprints on the element as a result of handling.

The different layers can be coated onto the support by any conventional coating technique, such as dip coating, knife coating, extrusion coating, spin coating, slide hopper coating and curtain coating.

Water-soluble or Water-dispersible Polymer

It is the gist of the present invention that the ink receiving layer contains a water-soluble or water-dispersible polymer comprising a repeating monomeric unit having a moiety capable of chelating boric acid by means of at least one nitrogen containing functional group and at least one hydroxyl group thereby forming a five- or six-membered ring.

For the preparation of the polymer in connection with the present invention the repeating monomeric unit defined above and having a moiety capable of chelating boric acid is preferably copolymerized with at least one other known conventional monomer. For example, this monomer can be chosen from: acrylic monomers, e.g. ethyl acrylate, butyl methacrylate, 2-ethylhexylacrylate, ethyl methacrylate, butyl acrylate, glycidylmethacrylate, hydroxyethyl acrylate, hydroxyethyl methacrylate, methyl acrylate, methyl methacrylate, 2-methoxyethyl acrylate, butyl diglycol methacrylate, trifluoroethyl methacrylate, 2-ethyl perfluoro alkyl acrylate, isooctyl acrylate, lauryl acrylate, stearyl methacrylate, lauryl methacrylate, isobornyl acrylate, dicyclopentenyloxyethyl methacrylate, t-butylaminoethyl methacrylate, 2-methoxyethyl acrylate, benzyl acrylate, 4-hydroxybutyl acrylate, acryloxyethyltrimethyl ammonium chloride, dimethylaminoethyl acrylate, dimethylaminoethyl methacrylate, dimethylamino propyl methacrylate, dimethyl amino ethyl methacrylamide, dimethylaminopropyl methacryl-amide, methacryloxyethyl trimethyl ammonium chloride, diethylene glycol methacrylate, diethylene glycol acrylate, dipropylene glycol methacrylate, 2-acetoacetoxyethyl methacrylate, 2-acetoacetoxyethyl acrylate, vinyltrimethoxysilane, pentaerythritol acrylate, methacyloxypropyl trimethoxy silane, tert. butyl methacrylate, acryloxyethyldimethyl benzyl ammonium chloride, benzyl methacrylate, methacrylate terminated polyethers, cyclohexyl methacrylate, glycerol monomethacrylate, glycidyl acrylate, n-hexyl acrylate, tetraethyleneglycol dimethacrylate and allylmethacrylate; vinyl esters, e.g. vinyl versatate, triethylene glycol divinyl ether tripropylene glycol diacrylate, vinyl acetate, vinyl terminated poly(ethylene oxide), allyl terminated poly(ethylene oxide), neopentyl vinylether; and other monomers e.g. vinyl alcohol, vinyl amine, vinylacetamide, allylamine, vinyl imidazole, vinyl pyrrodidone, diallyl amine, diallyl dimethylammonium chloride, methacryloyl ethyl trimethylammonium chloride, methacryloyl propyl trimethylammonium chloride, butadiene, isoprene, ethylene, diacetone acrylamide, 2-acrylamido-2-methyl-1-propanesulfonic acid, acrylic acid, methacrylic acid, styrene, acrylamide, acrylonitrile, diethyl maleate, dibutyl maleate, 4-vinylpyridine, 2-vinyl pyridine, methacrylonitrile, N-methylol acrylamide, and vinyl formamide. Examples of the synthesis of such copolymers are described in the examples section hereinafter.

Preferably the polymer used in accordance with the present invention is a water-dispersible polymeric latex. When the polymer is water-soluble or a film-forming latex it can be advantageously used as binder for the ink receiving layer.

The particular advantage of using such a polymer as binder in an ink receiving layer can be explained as follows. One way for assuring a good ink uptake is a sufficient porosity of the layer. This can be realized by means of a high ratio of amount of pigment (e.g. silica, alumina) versus binder (e.g. polyvinyl alcohol). However, such a high pigment/binder ratio tends to deteriorate the mechanical strength of the layer resulting in the occurrence of cracks and curling. Contrary to conventional binders the polymers used in the present invention are able to crosslink between the pigment and the hardener, which is preferably boric acid since the polymer binder is defined as having a chelating property for this hardener. Very efficient crosslinking is obtained. As a result it is possible to use relative high amounts of polymer binder (up to 20% versus 80% of pigment) resulting in good mechanical cohesion and absence of cracking and curling while retaining sufficient porosity.

When the latex is not film-forming it can serve as a pigment. In microporous layers often silica or alumina is used as pigment to create porosity. In the same way a non-film-forming latex can be used as particle to create porosity. Furthermore, when a latex is not film forming the particle surface stays intact and can offer surfaces inside the coating. In a heterogeneous system comprising a non-film-forming latex the surface of the latex can interact for example with the dyes from the ink. In this case, or when for some reason an extra second binder is desired this can be chosen from the compounds well-known in the art of ink-jet recording. Useful binders include hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinyl acetal; polyvinyl pyrrolidone; polyacrylamide; acrylamide/acrylic acid copolymer; polystyrene, styrene copolymers; acrylic or methacrylic polymers; styrene/acrylic copolymers; ethylene-vinylacetate copolymer; vinylmethyl ether/maleic acid copolymer; poly(2-acrylamido-2-methyl propane sulfonic acid); poly(diethylene triamine-co-adipic acid); polyvinyl pyridine; polyvinyl imidazole; polyethylene imine epichlorohydrin modified; polyethylene imine ethoxylated; polyethylene oxide; polyurethane; melamine resins; gelatin; carrageenan; dextran; gum arabic; casein; pectin; albumin; starch; collagen derivatives; collodion and agar-agar.

Monomeric Unit Having a Moiety Capable of Chelating Boric Acid

A preferred class of monomers is represented by formula (I):

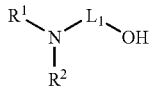

(I)

wherein $R^1$ and $R^2$ are selected independently from the group consisting of hydrogen, a substituted or unsubstituted, saturated or unsaturated aliphatic group, a substituted or unsubstituted aryl group, and a substituted or unsubstituted heteroaryl group; $L_1$ represents a linking group containing two or three straight chain carbon atoms which may be further substituted or may be part of a ring; any of $L_1$, $R^1$ and $R^2$ may combine to form a ring, and at least one of $L_1$, $R^1$ and $R^2$ comprises an ethylenically unsaturated polymerizable group. Any of $L_1$, $R^1$ and $R^2$ may be substituted by one or more groups comprising one or more additional hydroxyl group, amino groups and amide groups.

Another preferred class of monomers is represented by formula (II):

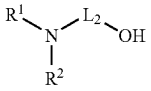

(II)

wherein $R^1$ and $R^2$ have the same meaning as for formula (I) and are selected independently from the group consisting of hydrogen, a substituted or unsubstituted, saturated or unsaturated aliphatic group, a substituted or unsubstituted aryl group, and a substituted or unsubstituted heteroaryl group; $L_2$ represents a linking group containing two or three carbon atoms which may be further substituted or may be part of a ring; any of $L_2$, $R^1$ and $R^2$ may combine to form a ring, and at least one of $L_2$, $R^1$ and $R^2$ comprises an ethylenically unsaturated polymerizable group. $L_2$ is preferably selected from the group consisting of $—CH_2CH_2—$, $—CH_2CH_2CH_2—$, $—CH_2CH(CH_3)—$, $—CH(CH_3)CH_2—$, $—CH_2CH(CH_2OH)—$, $—CH(CH_2OH)CH_2—$, $—CH═CH—$, $—CH═CHCH_2—$, $—C≡CCH_2—$, $—CH_2CH═CH—$, $—CH_2C≡C—$, $—CH═C(CH_3)—$ and $—C(CH_3)═CH—$. $L_2$, $R^1$ and $R^2$ may be substituted by one or more groups comprising one or more additional hydroxyl group, amino groups and amide groups.

A still further preferred class of monomers is represented by formula (III):

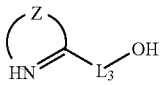

(III)

wherein Z represents the necessary atoms to form a substituted or unsubstituted five- or six-membered heteroring; $L_3$ represents a linking group containing one or two carbon atoms which may be further substituted or may be part of a ring, and at least one of the heteroring or $L_3$ comprises an ethylenically unsaturated polymerizable group. $L_3$ is preferably selected from the group consisting of $—CH_2CH_2—$, $—CH(CH_3)—$, $—CH═CH—$ and $—C≡C—$. $L_3$ may be substituted by one or more groups comprising one or more additional hydroxyl group, amino groups and amide groups. Furthermore, a hydrogen atom of $L_3$ may be replaced by a substituted or unsubstituted, saturated or unsaturated aliphatic group, a substituted or unsubstituted aryl group, and a substituted or unsubstituted heteroaryl group.

Illustrative monomers according to formula (I) are given in Table 1 below:

TABLE 1

| Monomer No. | Structure |
|---|---|
| I-1 | 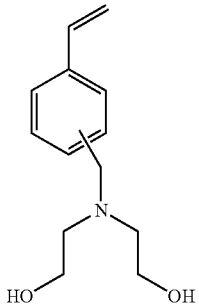 |
| I-2 | 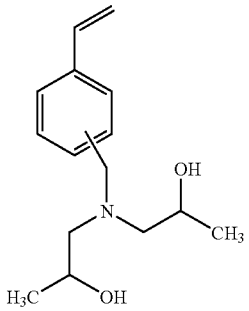 |
| I-3 | 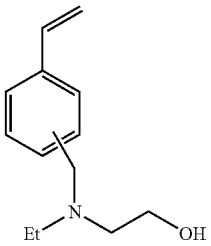 |

TABLE 1-continued
| Monomer No. | Structure |
|---|---|
| I-4 | 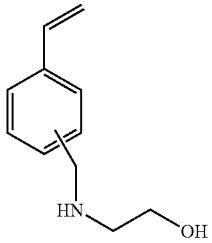 |
| I-5 | 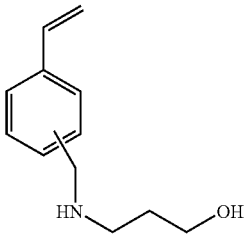 |
| I-6 | 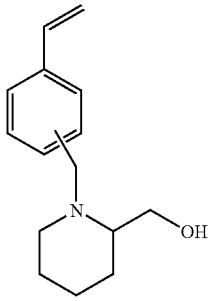 |
| I-7 | 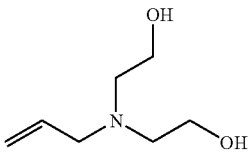 |
| I-8 | 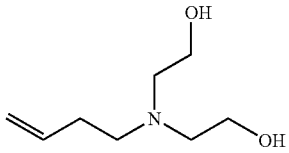 |
| I-9 | 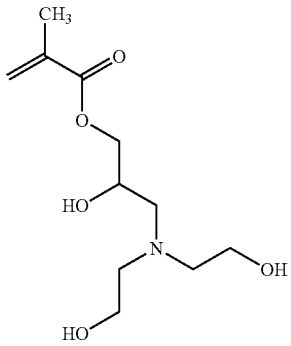 |
TABLE 1-continued
| Monomer No. | Structure |
|---|---|
| I-10 | 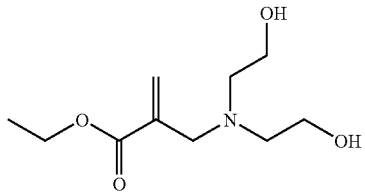 |
| I-9 | 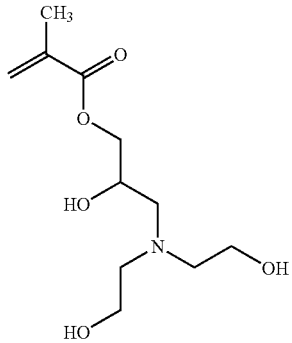 |
| I-10 | 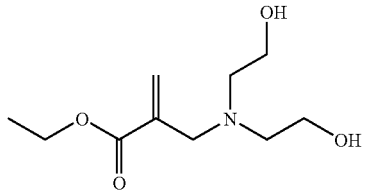 |
| I-11 | 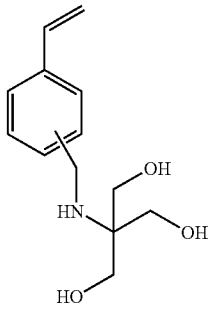 |
| I-12 | 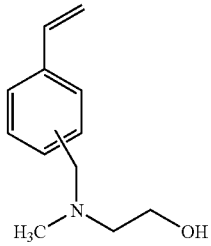 |
| I-13 | 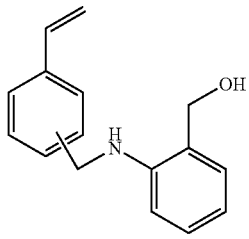 |

TABLE 1-continued

| Monomer No. | Structure |
|---|---|
| I-14 | 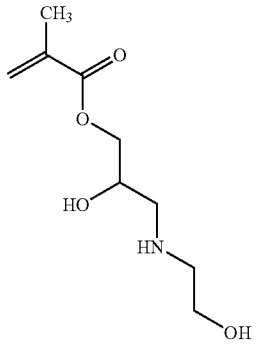 |
| I-15 | 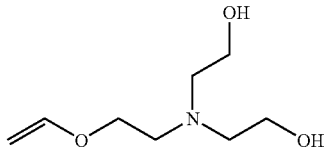 |
| I-16 | 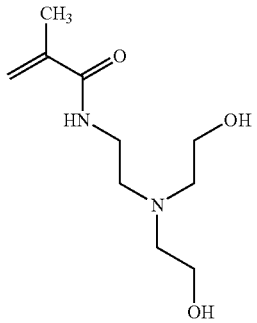 |
| I-17 | 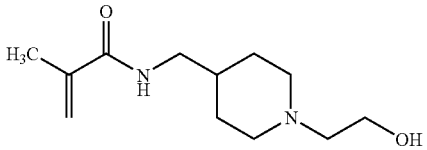 |
| I-18 | 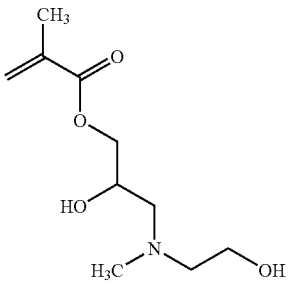 |

Illustrative monomers according to formula (II) are given in Table 2 below:

TABLE 2

| Monomer No. | Structure |
|---|---|
| II-1 | 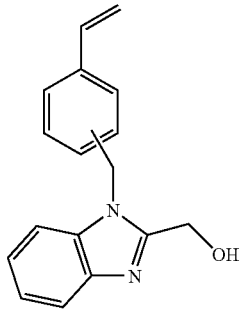 |
| II-2 | 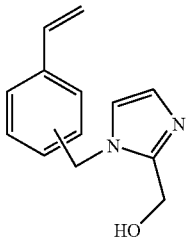 |
| II-3 | 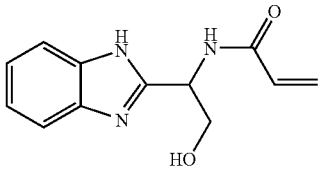 |
| II-4 | 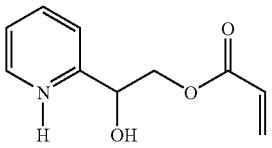 |
| II-5 | 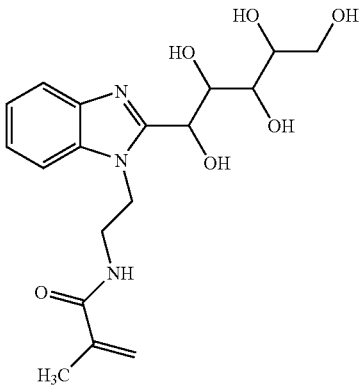 |

Preparation of Monomers:

Some of the monomers of Tables 1 and 2, usable for polymer synthesis in connection with the present invention are known, e.g. compound I-1, others may not have been disclosed as such, but they can be easily prepared by one skilled in the art using well-known synthesis techniques.

Some examples of the preparation of monomers are given hereinafter.

Synthesis of monomer I-1:

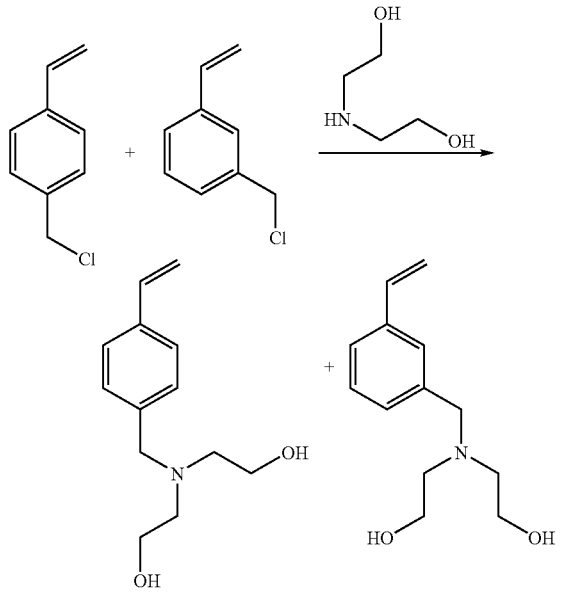

A mixture of 185 g (1.21 mol) of chloromethylstyrene (a mixture of the 3- and the 4-isomer), 636 g (6 mol) of diethanolamine and 2.6 g of 2,6-di-tert. butyl-4-methylphenol as polymerization inhibitor was heated to 90° C. The reaction was allowed to continue for 2 hours at 90° C. After cooling down to room temperature, 400 mL of methylene chloride was added. The mixture was first extracted with 400 mL of water and then twice with 100 mL of water. The pooled aqueous fractions were extracted twice with 150 mL of methylene chloride. The pooled organic fractions were dried over $Na_2SO_4$ and evaporated under reduced pressure. 252 g (99%) of monomer I-1 was isolated as a mixture of a 3- and a 4-isomer. The compound could be used for polymerization without further purification.

Synthesis of Monomer I-3:

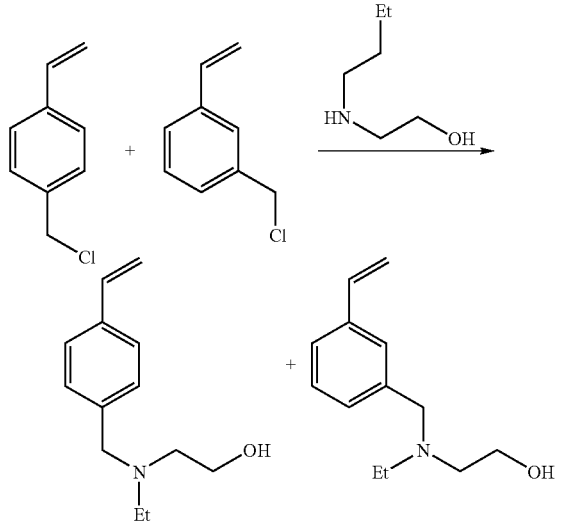

26.75 g (0.3 mol) of hydroxyethyl-ethylamine, 0.59 g (4.8 mmol) of 4-methoxyphenol and 0.24 g (1.6 mmol) of sodium iodide were dissolved in 150 mL of acetonitrile. A solution of 18.3 g (0.12 mol) of chloromethylstyrene (a mixture of the 3- and 4-isomer) in 30 mL of acetonitrile was added and the reaction mixture was refluxed for 2 hours. After cooling down to room temperature, the solvent was evaporated under reduced pressure and the residue was redissolved in 150 mL of methylene chloride. The methylene chloride solution was extracted with 200 mL of water. The aqueous layer was extracted three times with 100 mL of methylene chloride. The pooled methylene chloride fractions were dried over $Na_2SO_4$. The solvent was removed under reduced pressure and monomer I-3 was isolated by preparative column chromatography (eluent: $CH_2Cl_2$/MeOH 90/10 on Kromasil 60A 10 μm). 17.2 g (yield 70%) of monomer I-3 was isolated as an oily compound.

Pigment

The ink receiving layer in this invention is preferably a porous layer and therefore preferably contains a pigment. Preferably an inorganic pigment is used, which can be chosen from neutral, anionic and cationic pigment types. Useful pigments include e.g. silica, talc, clay, hydrotalcite, kaolin, diatomaceous earth, calcium carbonate, magnesium carbonate, basic magnesium carbonate, aluminosilicate, aluminum trihydroxide, aluminum oxide (alumina), titanium oxide, zinc oxide, barium sulfate, calcium sulfate, zinc sulfide, satin white, alumina hydrate such as boehmite, pseudo boehmite, aluminum oxide, zirconium oxide or mixed oxides. Preferably, the pigment is a cationic type pigment selected from alumina hydrates, aluminum oxides, aluminum hydroxides, aluminum silicates, and cationically modified silicas.

A preferred type of alumina hydrate is crystalline boehmite, or γ-AlO(OH). Useful types of boehmite include, in powder form, DISPERAL, DISPERAL HP14 and DISPERAL 40 from Sasol, MARTOXIN VPP2000-2 and GL-3 from Martinswerk GmbH.; liquid boehmite alumina systems, e.g. DISPAL 23N4-20, DISPAL 14N-25, DISPERAL AL25 from Sasol, boehmite dispersions BACASOL 2C and BACASOL 3C from Alcan. Patents on alumina hydrate include EP 500021, EP 634286, U.S. Pat. No. 5,624,428, EP 742108, U.S. Pat. No. 6,238,047, EP 622244, EP 810101, etc. Useful cationic aluminum oxide (alumina) types include $\alpha$-$Al_2O_3$ types, such as NORTON E700, available from Saint-Gobain Ceramics & Plastics, Inc, and $\gamma$-$Al_2O_3$ types, such as ALUMINUM OXID C from Degussa; other aluminum oxide grades, such as BAIKALOX CR15 and CR30 from Baikowski Chemie; DURALOX grades and MEDIALOX grades from Baikowski Chemie, BAIKALOX CR80, CR140, CR125, B105CR from Baikowski Chemie; CAB-O-SPERSE PG003 trademark from Cabot, CATALOX GRADES and CATAPAL GRADES from from Sasol, such as PLURALOX HP14/150; colloidal $Al_2O_3$ types, such as ALUMINASOL 100; ALUMINASOL 200, ALUMINASOL 220, ALUMINASOL 300, and ALUMINASOL 520 trademarks from Nissan Chemical Industries or NALCO 8676 trademark from ONDEO Nalco.

Other useful cationic inorganic pigments include aluminum trihydroxides such as Bayerite, or $\alpha$-$Al(OH)_3$, such as PLURAL BT, available from Sasol, and Gibbsite, or $\gamma$-$Al(OH)_3$, such as MARTINAL grades from Martinswerk GmbH, MARTIFIN grades, such as MARTIFIN OL104, MARTIFIN OL 107 and MARTIFIN OL111 from Martinswerk GmbH MICRAL grades, such as MICRAL 1440, MICRAL 1500; MICRAL 632; MICRAL 855; MICRAL 916; MICRAL 932; MICRAL 932CM; MICRAL 9400 from JM Huber company; HIGILITE grades, e.g. HIGILITE H42 or HIGILITE H43M from Showa Denka K.K., HYDRAL COATES grades from Alcoa Co., such as HYDRAL COAT 2, 5, and 7, HYDRAL PGA and HYDRAL 710.

Another useful type of cationic pigment is zirconium oxide such as NALCO OOSS008 trademark of ONDEO Nalco, acetate stabilized $ZrO_2$, ZR20/20, ZR50/20, ZR100/20 and ZRYS4 trademarks from Nyacol Nano Technologies. Useful mixed oxides are SIRAL grades from Sasol, colloidal metal oxides from Nalco such as Nalco 1056, Nalco TX10496, Nalco TX11678.

Another preferred type of inorganic pigment is silica which can be used as such in its anionic form or after cationic modification. Silica as pigment in ink receiving elements is disclosed in numerous old and recent patents, e.g. U.S. Pat. Nos. 4,892,591, 4,902,568, EP 373573, EP 423829, EP 487350, EP 493100, EP 514633, etc. The silica can be chosen from different types, such as crystalline silica, amorphous silica, precipitated silica, fumed silica, silica gel, spherical and non-spherical silica. The silica may contain minor amounts of metal oxides from the group Al, Zr, Ti. Useful types include AEROSIL OX50 (BET surface area 50±15 $m^2/g$, average primary particle size 40 nm, $SiO_2$ content >99.8%, $Al_2O_3$ content <0.08%), AEROSIL MOX170 (BET surface area 170 $g/m^2$, average primary particle size 15 nm, $SiO_2$ content >98.3%, $Al_2O_3$ content 0.3-1.3%), AEROSIL MOX80 (BET surface area 80±20 $g/m^2$, average primary particle size 30 nm, $SiO_2$ content >98.3%, $Al_2O_3$ content 0.3-1.3%), or other hydrophilic AEROSIL grades available from Degussa-Hüls AG, which may give aqueous dispersions with a small average particle size (<500 nm).

Cationically modified silica can be prepared by following methods, without meaning to be limitative: (1) subjecting silica to a surface treatment with an inorganic cationic compound such as particular metal oxides and oxyhydroxides, e.g. aluminum oxides, and alumina hydrates such as boehmite and pseudo-boehmite; a useful cationic inorganic compound to modify silica is pseudo-boehmite. Pseudo-boehmite is also called boehmite gel and is fine particulate alumina hydrate having a needle form. The composition thereof is generally represented by $Al_2O_3.1.5\text{-}2H_2O$ and differs from that of crystalline boehmite; (2) by subjecting silica to a surface treatment with an organic compound having both an amino group or quaternary ammonium group thereof or a quaternary phosphonium group, and a functional group having reactivity to a silanol group on the surface of silica, such as aminoalkoxysilane or aminoalkyl glycidyl ether or isopropanol amine; and (3) by polymerisation of a cationic or amino functional monomer in the presence of a silica.

In an alternative embodiment the pigment may be chosen from organic particles such as polystyrene, polymethyl methacrylate, silicones, melamine-formaldehyde condensation polymers, urea-formaldehyde condensation polymers, polyesters and polyamides. Mixtures of inorganic and organic pigments can be used. However, most preferably the pigment is an inorganic pigment.

The pigment must be present in a sufficient coverage in order to render the ink receiving layer sufficiently porous.

For obtaining glossy ink receiving layers the particle size of the pigment should preferably be smaller than 500 nm. In order to obtain a porous glossy layer which can serve as an ink receiving layer for fast ink uptake the pigment/binder ratio should be at least 4. Only at these high ratios the binder is no longer able to fill up all pores and voids created by the pigments in the coating. To achieve a sufficient porosity of the coating for fast ink uptake the pore volume of these highly pigmented coatings should be higher than 0.1 mL/g of coated solids. This pore volume can be measured by gas adsorption (nitrogen) or by mercury diffusion.

Cationic Mordants

Apart from the essential ingredients described above a cationic substance acting as mordant may be present in the ink receiving layer. Such substances increase the capacity of the layer for fixing and holding the dye of the ink droplets. A particularly suited compound is a poly(diallyldimethylammonium chloride) or, in short, a poly(DADMAC). These compounds are commercially available from several companies, e.g. Aldrich, Nalco, CIBA, Nitto Boseki Co., Clariant, BASF and EKA Chemicals.

Other useful cationic compounds include DADMAC copolymers such as copolymers with acrylamide, e.g NALCO 1470 trade mark of ONDEO Nalco or PAS-J-81, trademark of Nitto Boseki Co., such as copolymers of DADMAC with acrylates, such as Nalco 8190, trademark of ONDEO Nalco; copolymers of DADMAC with $SO_2$, such as PAS-A-1 or PAS-92, trademarks of Nitto Boseki Co., copolymer of DADMAC with maleic acid, e.g. PAS-410, trademark of Nitto Boseki Co., copolymer of DADMAC with diallyl(3-chloro-2-hydroxypropyl)amine hydrochloride, eg. PAS-880, trademark of Nitto Boseki Co., dimethylamine-epichlorohydrine copolymers, e.g. Nalco 7135, trademark of ONDEO Nalco or POLYFIX 700, trade name of Showa High Polymer Co.; other POLYFIX grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine, and REDIFLOC 4150, trade name of EKA Chemicals, a polyamine; MADAME (methacrylatedimethylaminoethyl=dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic acrylic polymers, such as ALCOSTAT 567, trademark of CIBA, cationic cellulose derivatives such as CELQUAT L-200, H-100, SC-240C, SC-230M, trade names of Starch & Chemical Co., and QUATRISOFT LM200, UCARE polymers JR125, JR400, LR400, JR30M, LR30M and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, trade name of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; phosphonium compounds such as disclosed in EP 609930 and other cationic polymers such as NEOFIX RD-5, trademark of Nicca Chemical Co.

Surfactant

Surfactants may be incorporated in the layers of the recording material of the present invention. They can be any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, α-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropyl-alkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$-$C_{10}$ alkyl-carboxylic acids, disodium N-perfluorooctanesulfonyl glutamate, sodium 3-(fluoro-$C_6$-$C_{11}$-alkyloxy)-1-$C_3$-$C_4$ alkyl sulfonates, sodium 3-(ω-fluoro-$C_6$-$C_8$-alkanoyl-N-ethylamino)-1-propane sulfonates, N-[3-(perfluorooctanesulfonamide)-propyl]-N,N-dimethyl-N-carboxymethylene ammonium betaine, fluoro-$C_{11}$-$C_{20}$ alkylcarboxylic acids, perfluoro-$C_7$-$C_{13}$-alkyl-carboxylic acids, perfluorooctane sulfonic acid diethanolamide, Li, K and Na perfluoro-$C_4$-$C_{12}$-alkyl sulfonates, N-propyl-N-(2-hydroxyethyl)perfluorooctane sulfonamide, perfluoro-$C_6$-$C_{10}$-alkylsulfonamide-propyl-sulfonyl-glycinates, bis-(N-perfluorooctylsulfonyl-N-ethanolaminoethyl)phosphonate, mono-perfluoro $C_6$-$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimonium-chloride phosphate, palmityl trimethylammonium chloride, and cetyltrimethylammonium bromide.

Especially useful are the fluorocarbon surfactants as described in e.g. U.S. Pat. No. 4,781,985, having a structure of:

$F(CF_2)_{4\text{-}9}CH_2CH_2SCH_2CH_2N^+R_3X^-$ wherein R is a hydrogen or an alkyl group; and in U.S. Pat. No. 5,084,340, having a structure of:

$CF_3(CF_2)_mCH_2CH_2O(CH_2CH_2O)_nR$ wherein m=2 to 10; n=1 to 18; hydrogen or an alkyl group of 1 to 10 carbon atoms. These surfactants are commercially available from DuPont and 3M. The concentration of the surfactant component in the ink-receiving layer is typically in the range of 0.1 to 2%, preferably in the range of 0.4 to 1.5% and is most preferably 0.75% by weight based on the total dry weight of the layer.

Crosslinking Agent

The preferred crosslinking agent (or hardener) incorporated in the ink receiving layer(s) and/or in an auxiliary layer is a crosslinking agent capable of crosslinking the water-soluble or water-dispersible polymers used in the ink-jet receiving material, according to the present invention. Crosslinking agents capable of crosslinking the water-soluble or water-dispersible polymers used in the ink-jet receiving material include boric acid, borates, titanates, zirconates, polyfunctional isocyanates, aldehydes, acetals, epoxides and compounds capable of releasing polyfunctional isocyanates, epoxides and aldehydes upon the application of heat or upon hydrolysis i.e. so-called blocked polyfunctional isocyanates, epoxides and aldehydes.

There are a vast number of known crosslinking agents that will function to crosslink film forming binders, including formaldehyde and free dialdehydes, such as succinaldehyde and glutaraldehyde, blocked dialdehydes, dimethoxyethanal, melamine dimethoxyethanal, urea dimethoxyethanal, active esters, sulfonate esters, active halogen compounds, isocyanate or blocked isocyanates, polyfunctional isocyanates, melamine derivatives, s-triazines and diazines, epoxides, active olefins having two or more active bonds, carbodiimides, zirconium complexes, e.g. BACOTE 20 and ZIRMEL 1000 (trademarks of MEL Chemicals), zirconium lactate, zirconium triethanol amine chelate, zirconium glycolate or zirconium acetate, titanium complexes, such as TYZOR grades, e.g. TYZOR LA, TYZOR 131, TYZOR AA and TYZOR TE all trademarks from DuPont, isoxazolium salts subsituted in the 3-position, esters of 2-alkoxy-N-carboxy-dihydroquinoline, N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly (acrolein-methacrylic acid), and oxazoline functional polymers, e.g. EPOCROS WS-500, and EPOCROS K-1000 series, and maleic anhydride copolymers, e.g. GANTREZ AN119.

However, as explained above, for the practice of the present invention boric acid is the preferred crosslinker. A further crosslinking agent in addition to boric acid may also be used in the ink-jet receiving material, according to the present invention.

Plasticizer

The ink-receiving layer and the optional auxiliary layer(s) may also comprise a plasticizer such as ethylene glycol, diethylene glycol, propylene glycol, polyethylene glycol, glycerol monomethylether, glycerol monochlorohydrin, ethylene carbonate, propylene carbonate, urea phosphate, triphenylphosphate, glycerol-monostearate, propylene glycol monostearate, tetramethylene sulfone, n-methyl-2-pyrrolidone, n-vinyl-2-pyrrolidone.

The present invention will now be illustrated by the following examples without however being limited thereto.

EXAMPLE 1

Example of Polymer Synthesis

Monomer I-1 of Table 1: Isomeric Mixture of 2-[(2-hydroxy ethyl)-(4-vinyl phenyl)-amino]ethanol (or 2,2'-[[(4-ethenylphenyl)methyl]-imino]bis ethanol=CASRN58436-69-4) and 2-[(2-hydroxy ethyl)-(3-vinyl phenyl)-amino]ethanol (or 2,2'-[[(3-ethenylphenyl)methyl]-imino]bis ethanol):

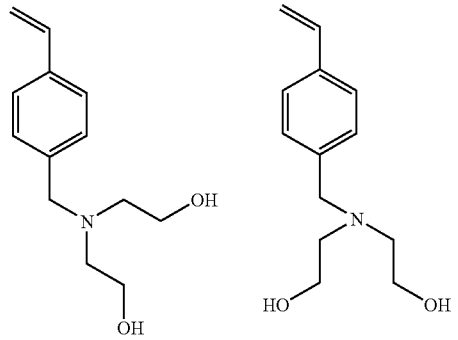

Synthesis of Polymer 1: i.e. Water Based Emulsion Copolymer Based on a Copolymer of Ethylacrylate and Monomer I-1.

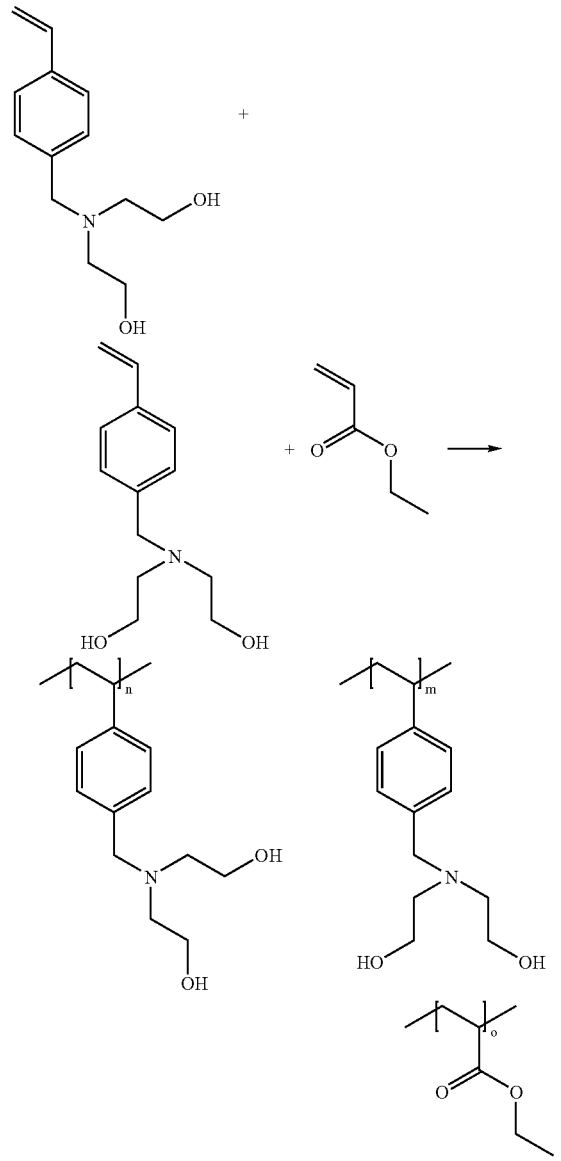

where n, m and o merely give the proportions of the three monomers in the polymer chain, but give no information on how these monomer units are distributed along the polymer chain.

Polymer 1 was prepared via a semi-continuous emulsion polymerization. 11.13 g of cetyldimethylbenzylammonium chloride was dissolved in 1269 g of water in a 2 liter jacketed reactor with nitrogen flow and stirred at 250 rpm. Subsequently the reactor was heated to 85° C. When the reactor reached 85° C. 252 g of ethyl acrylate and 108 g of monomer I-1 was added to the reactor. The emulsion was stirred for 5 minutes. Subsequently the reaction was initiated by addition of 13.5 g of a 2% aqueous solution of 2,2'-azobis(2-amidinopropane) dihydrochloride (WAKO V50). After nucleation of the latex a monomer mixture composed of 214.2 g ethylacrylate and 91.8 g of monomer I-1 was added during 90 minutes. Simultaneously, 76.5 g of a 2% aqueous solution of 2,2'-azobis(2-amidinopropane) dihydrochloride (WAKO V50) was dosed in 110 minutes. When all ingredients were added to the reactor the reaction was allowed to continue for 30 minutes. Subsequently a post-initiation was done by adding simultaneously 19.59 g of a 5% hydrogen peroxide and 50.74 g of a 10 wt % aqueous ascorbic acid solution during 5 minutes. After an additional hour of reaction, the residual monomer was removed by vacuum distillation during 1 hour. The latex was cooled to room temperature and subsequently the latex was filtered over coarse filtration paper. The emulsion polymerization resulted in a latex having an average particle size of 84 nm, a pH of 6.3, a viscosity of 4.3 mPa·s and a solids content of 19.6 weight %.

EXAMPLE 2

Example of Polymer Synthesis

Monomer I-3 of Table 1: Isomeric Mixture of 2-[ethyl-(3-vinyl phenyl)-amino]ethanol and 2-[ethyl-(4-vinyl phenyl)-amino]ethanol:

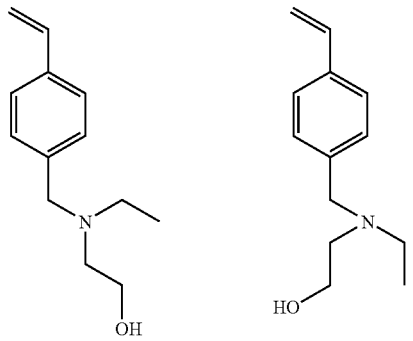

Synthesis of Polymer 2: i.e. Water Based Emulsion Copolymer Based on a Copolymer of Ethylacrylate and Monomer I-3.

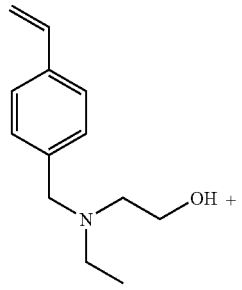

-continued

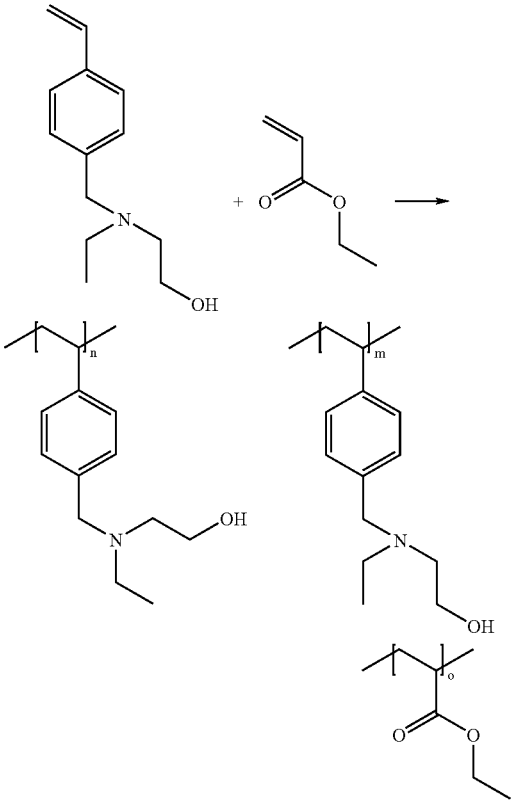

where n, m and o merely give the proportions of the three monomers in the polymer chain, but give no information on how these monomer units are distributed along the polymer chain.

Polymer 2 was prepared via a semi-continuous emulsion polymerization. 1.55 g of cetyldimethylbenzylammonium chloride was dissolved in 172 g of water in a 500 mL jacketed reactor with nitrogen flow and stirred at 250 rpm. Subsequently the reactor was heated to 85° C. When the reactor reached 85° C., 5.25 grams of ethylacrylate and 2.25 grams of monomer I-3 was added to the reactor. The emulsion was stirred for 5 minutes. Subsequently the reaction was initiated by addition of 1.88 gram of a 2% aqueous solution of 2,2'-azobis(2-amidinopropane) dihydrochloride (WAKO V50). After nucleation of the latex a monomer mixture composed of 29.75 gram of ethyl acrylate and 12.75 grams of monomer I-3 was added during 90 minutes. Simultaneously, 10.63 grams of a 2% aqueous solution of 2,2'-azobis(2-amidinopropane) dihydrochloride (WAKO V50) was dosed in 110 minutes. When all ingredients were added to the reactor the reaction was allowed to continue for 30 minutes. Subsequently a post-initiation was done by adding simultaneously 7.05 gram of a 5% hydrogen peroxide and 7.05 gram of a 10 wt % aqueous ascorbic acid solution during 5 minutes. After an additional hour of reaction, the residual monomer was removed by vacuum distillation during 1 hour. The latex was cooled to room temperature and subsequently the latex was filtered over coarse filtration paper. The emulsion polymerization resulted in a latex having an average particle size of 474 nm, a pH of 6.6, a viscosity of 5.6 mPa·s and a solids content of 19.2 weight %.

EXAMPLE 3

Example of Polymer Synthesis

Synthesis of Polymer 3: i.e. Water-soluble Copolymer Based on a Copolymer of Diallyldimethylammonium Chloride (DADMAC) and Monomer I-1.

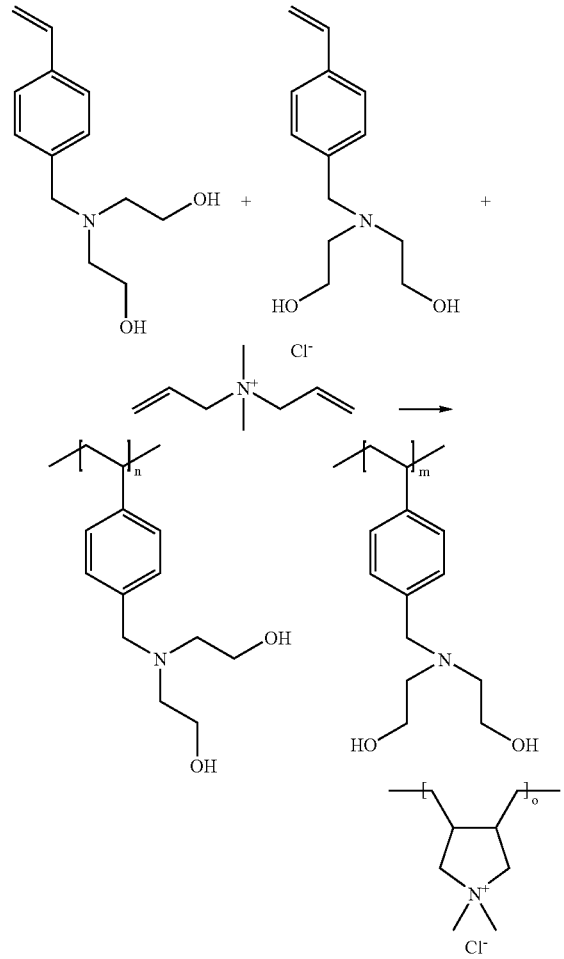

where n, m and o merely give the proportions of the three monomers in the polymer chain, but give no information on how these monomer units are distributed along the polymer chain.

691 g of a 65 wt % aqueous solution of diallyldimethylammonium chloride and 30.85 gram of monomer I-1 were dissolved in water in a 2 l jacketed reactor with nitrogen flow and stirred at 250 rpm. The reactor was heated to 60° C. and 48 g of a 10 weight % aqueous solution of 2,2'-azobis(2-amidinopropane) dihydrochloride (WAKO V50) was added during 6 hours. Subsequently the reaction temperature was raised to 70° C. and 24 g of a 10% aqueous solution of WAKO V50 was added during 3 hours. After 16 hours of reaction time the reaction mixture was cooled to room temperature and an emulsion was obtained having a pH of approx. 8.1. The pH was reduced to pH 4.56 by is addition of 35 g of a 4N aqueous solution of hydrogen chloride. The solids content of the obtained aqueous solution was 31.7 weight %.

EXAMPLE 4

Example of Evaluation in an Ink-jet Recording Material

Preparation of the Coating Solutions

Comparative sample: a coating liquid for forming an ink recording layer was prepared by adding 30 parts by solid weight of a 40% aqueous solution of alumina (CAB-O-SPERSE PG003 provided by Cabot Corp.) together with 1.5 parts by weight of a 4% aqueous solution of boric acid to 6.0 parts by weight of a 10% aqueous solution of polyvinyl alcohol (GOSHEFIMER K210 provided by Nippon Goshei).

Invention sample: same procedure as for the comparative sample with the exception that in the preparation of the coating liquid for the ink receiving layer, the polyvinyl alcohol was replaced by 15.0 parts by weight of a 20% aqueous latex dispersion corresponding to Polymer 1 and the amount of boric acid was increased to 7.5 parts by weight.

Coating and Evaluation of the Coated Samples

The two coating solutions were coated on a subbed PET sheet (100 μm) using a blade-coater to form an ink receiving layer having a dry weight of 31.5 g/m$^2$, and dried at 40° C. The cracking of the coating was visually evaluated.

Color patches containing primary and secondary colors were printed on the coated samples by means of a EPSON STYLUS Photo 870 ink-jet printer (trademark of Seiko Epson Corp.). By means of these color patches the intercolor bleeding, image irregularity and the drying speed can be evaluated. The drying speed is evaluated by rubbing the primary colors and the secondary colors with the finger immediately (within 5 seconds) after printing. When no smearing of the colors is observed, the recording media is called instant dry. The image irregularity was visually observed in the green solid colors (yellow+cyan). The color bleeding was rated 1 to 5 on a qualitative arbitrary scale with 5 being best without any color bleeding. The test results are shown in Table 3.

TABLE 3

| Sample | Cracking | Instant dry for primary colors | Instant dry for secondary colors | Bleeding | Irregularity in solid green |
|---|---|---|---|---|---|
| Comparative | No | Yes | No | 2 | Yes |
| Invention | No | Yes | No | 4 | No |

As can be seen, the coated and printed invention sample described in this example 4 with a much higher binder (Polymer 1) concentration compared to the comparative sample, shows a higher image quality without imparting negatively the physical properties as drying time and cracking.

EXAMPLE 5

Example of Evaluation in an Ink-jet Recording Material

An ink-jet recording medium was produced by the same procedures as the invention sample in Example 4 with the exception that in the preparation of the coating liquid for the ink receiving layer, the inorganic pigment was replaced by 30 parts by solid weight of a 40% aqueous solution of silica (AERODISP W340 provided by Degussa Corp.) together with 2.0 parts by weight of commercial pseudo-boehmite DISPERAL P3, trade name of Sasol Co., 15% dispersion in water. The concentration of the binder was decreased to 6.6 parts by weight of the 20% aqueous latex dispersion corresponding with Polymer 1 and the amount of boric acid was decreased to 6.6 parts by weight of a 4% aqueous solution. The comparative sample of example 5 was obtained by using 6.0 parts by weight of a 10% aqueous solution of polyvinyl alcohol (GOSHEFIMER K210 provided by Nippon Goshei) instead of Polymer 1 as binder.

The samples were coated and printed in the same way as in example 4. The results are shown in Table 4.

TABLE 4

| Sample | Cracking | Instant dry for primary colors | Instant dry for secondary colors | Irregularity in solid green |
|---|---|---|---|---|
| Comparative | Yes | Yes | No | Yes |
| Invention | No | Yes | No | No |

As can be seen, the coated and printed invention sample described in this example 5 with Polymer 1 as binder shows better image quality, physical properties for the same ink drying time than the comparative samples with polyvinyl alcohol as binder.

Having described in detail preferred embodiments of the current invention, it will now be apparent to those skilled in the art that numerous modifications can be made therein without departing from the scope of the invention as defined in the appending claims.

We claim:

1. An ink jet recording material comprising a support and at least one ink receiving layer containing a water-soluble or water-dispersible polymer, wherein said polymer comprises a repeating monomeric unit having a moiety capable of chelating boric acid by means of at least one nitrogen containing functional group and at least one hydroxyl group thereby forming a five- or six-membered ring and wherein said repeating monomeric unit is represented by formula (II):

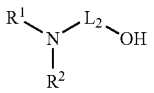

(II)

wherein, $R^1$ is selected from the group consisting of a substituted saturated aliphatic group, an unsubstituted saturated aliphatic group, a substituted unsaturated aliphatic group, a substituted or unsubstituted aryl group, and a substituted or unsubstituted heteroaryl group;

$R^2$ is selected from the group consisting of hydrogen, a substituted or unsubstituted, saturated or unsaturated aliphatic group, a substituted or unsubstituted aryl group, and a substituted or unsubstituted heteroaryl group;

$L_2$ represents a linking group containing two or three carbon atoms which may be further substituted or may be part of a ring;

any of $L_2$, $R^1$ and $R^2$ may combine to form a ring, and at least one of $L_2$, $R^1$ and $R^2$ comprises an ethylenically unsaturated polymerizable group.

2. Ink jet recording material according to claim 1 wherein said linking group $L_2$ contains two or three straight chain carbon atoms which may be further substituted or may be part of a ring.

3. Ink jet recording material according to claim 1, wherein $L_2$ is selected from the group consisting of $—CH_2CH_2—$, $—CH_2CH_2CH_2—$, $—CH_2CH(CH_3)—$, $—CH(CH_3)CH_2—$, $—CH_2CH(CH_2OH)—$, $—CH(CH_2OH)CH_2—$, $—CH=CH—$, $—CH=CHCH_2—$, $—C\equiv CCH_2—$, $—CH_2CH=CH—$, $—CH_2C\equiv C—$, $—CH=C(CH_3)—$ and $—C(CH_3)=CH—$.

4. Ink jet recording material according to claim 1 wherein said polymer comprises at least one other repeating monomeric unit chosen from the list consisting of vinyl acetate, vinyl alcohol, dimethylaminoethyl methacrylate, vinyl amine, vinyl formamide, vinylacetamide, diallyl amine, Vinyl versatate, butyral acrylate, styrene, dimethylaminoethyl acrylate, methacryloxyethyltrimethyl ammonium chloride, ethylacrylate, butylmethacrylate, methyl methacrylate, butyl acrylate, 2-ethylhexyl methacrylate, diallyldimethyl ammonium chloride, 2-ethylhexyl acrylate, methacryloxyethyldimethyl-benzylammonium chloride, acryloxyethyldimethyl benzyl ammonium chloride, vinyl caprolactam and vinyl pyrrolidone.

5. Ink jet recording material according to claim 1 wherein said polymer is a latex.

6. Ink jet recording material according to claim 1 wherein said polymer is a copolymer with at least one other monomer.

7. Ink jet recording material according to claim 1 wherein said ink receiving layer further comprises a pigment.

8. Ink jet recording material according to claim 7 wherein said pigment is an inorganic pigment.

9. Ink jet recording material according to claim 8 wherein inorganic pigment is chosen from the group consisting of aluminum oxide, boehmite, pseudo-boehmite, gibbsite, bayerite, aluminum hydroxide, silica, clay, calcium carbonate, zirconia, and mixed inorganic oxides/hydroxides.

10. An ink jet recording material comprising a support and at least one ink receiving layer containing a water-soluble or waterdispersible polymer, wherein said polymer comprises a repeating monomeric unit having a moiety capable of chelating boric acid by means of at least one nitrogen containing functional group and at least one hydroxyl group thereby forming a five- or six-membered ring and wherein said repeating monomeric unit is represented by formula (II)

(I)

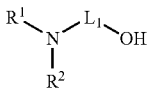

wherein $R^1$ is selected from the group consisting of a substituted saturated aliphatic group, an unsubstituted saturated aliphatic group, a substituted unsaturated aliphatic group, a substituted or unsubstituted aryl group, and a substituted or unsubstituted heteroaryl group;

$R^2$ is selected from the group consisting of hydrogen, a substituted or unsubstituted, saturated or unsaturated aliphatic group, a substituted or unsubstituted aryl group, and a substituted or unsubstituted heteroaryl group;

$L_2$ represents a linking group containing two or three carbon atoms which may be further substituted or may be part of a ring;

any of $L_2$, $R^1$ and $R^2$ may combine to form a ring, and at least one of $L_2$, $R^1$ and $R^2$ comprises an ethylenically unsaturated polymerizable group wherein said linking group $L_2$ contains two or three straight chain carbon atoms which may be further substituted or may be part of a ring and wherein any of $L_2$, $R^1$ and $R^2$ is substituted by one or more groups comprising one or more additional hydroxyl group, amino groups and amide groups.

11. Ink jet recording material according to claim 10 wherein said polymer comprises at least one other repeating monomeric unit chosen from the list consisting of vinyl acetate, vinyl alcohol, dimethylaminoethyl methacrylate, vinyl amine, vinyl formamide, vinylacetamide, diallyl amine, vinyl versatate, butyral acrylate, styrene, dimethylaminoethyl acrylate, methacryloxyethyltrimethyl ammonium chloride, ethylacrylate, butylmethacrylate, methyl methacrylate, butyl acrylate, 2-ethylhexyl methacrylate, diallyldimethyl ammonium chloride, 2-ethylhexyl acrylate, methacryloxyethyldimethyl-benzylammonium chloride, acryloxyethyldimethyl benzyl ammonium chloride, vinyl caprolactam and vinyl pyrrolidone.

12. Ink jet recording material according to claim 10 wherein said polymer is a latex.

13. Ink jet recording material according to claim 10 wherein said polymer is a copolymer with at least one other monomer.

14. Ink jet recording material according to claim 10 wherein said ink receiving layer further comprises a pigment.

15. Ink jet recording material according to claim 14 wherein said pigment is an inorganic pigment.

16. Ink jet recording material according to claim 15 wherein inorganic pigment is chosen from the group consisting of aluminum oxide, boehmite, pseudo-boehmite, gibbsite, bayerite, aluminum hydroxide, silica, clay, calcium carbonate, zirconia, and mixed inorganic oxides/hydroxides.

17. Ink jet recording material according to claim 10 wherein said ink receiving layer further contains a hardener capable of crosslinking said polymer.

18. Ink jet recording material according to claim 17 wherein said hardener is boric acid.

19. Ink jet recording material according to claim 10, wherein L2 is selected from the group consisting of $—CH_2CH_2—$; $—CH_2CH_2CH_2—$; $—CH_2CH(CH_3)—$; $—CH(CH_3)CH_2—$; $—CH_2CH(CH_2OH)—$; $—CH(CH_2OH)CH_2—$; $—CH=CH—$; $—CH=CHCH_2—$; $—C=CCH_2—$; $—CH_2CH=CH—$; $—CH_2C=C—$; $—CH=C(CH_3)—$ and $—C(CH_3)=CH—$.

20. An ink jet recording material comprising a support and at least one ink receiving layer containing a water-soluble or water-dispersible polymer, wherein said polymer comprises a repeating monomeric unit having a moiety capable of chelating boric acid by means of at least one nitrogen containing functional group and at least one hydroxyl group thereby forming a five- or six-membered ring and wherein said repeating monomeric unit is represented by formula (II):

(I)

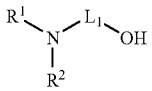

wherein, $R^1$ is selected from the group consisting of a substituted saturated aliphatic group, an unsubstituted saturated aliphatic group, a substituted unsaturated aliphatic group, a substituted or unsubstituted aryl group, and a substituted or unsubstituted heteroaryl group;

$R^2$ is selected from the group consisting of hydrogen, a substituted or unsubstituted, saturated or unsaturated aliphatic group, a substituted or unsubstituted aryl group, and a substituted or unsubstituted heteroaryl group;

$L_2$ represents a linking group containing two or three carbon atoms which may be further substituted or may be part of a ring;

any of $L_2$, $R^1$ and $R^2$ may combine to form a ring, and at least one of $L_2$, $R^1$ and $R^2$ comprises an ethylenically unsaturated polymerizable group wherein any of $L_2$, $R^1$ and $R^2$ is substituted by one or more groups comprising one or more additional hydroxyl group, amino groups and amide groups.

21. Ink jet recording material according to claim 20 wherein said ink receiving layer further contains a hardener capable of crosslinking said polymer.

22. Ink jet recording material according to claim 21 wherein said hardener is boric acid.

23. Ink Jet recording material according to claim 20, wherein said polymer comprises at least one other repeating monomeric unit chosen from the list consisting of vinyl acetate, vinyl alcohol, dimethylaminoethyl methacrylate, vinyl amine, vinyl formamide, vinylacetamide, diallyl amine, vinyl versatate, butyral acrylate, styrene, dimethylaminoethyl acrylate, methacryloxyethyltrimethyl ammonium chloride, ethylacrylate, butylmethacrylate, methyl methacrylate, butyl acrylate, 2-ethylhexyl methacrylate, diallyldimethyl ammonium chloride, 2-ethylhexyl acrylate, methacryloxyethyldimethyl-benzylammonium chloride, acryloxyethyldimethyl benzyl ammonium chloride, vinyl caprolactam and vinyl pyrrolidone.

24. Ink jet recording material according to claim 20, wherein said polymer is a latex.

25. Ink jet recording material according to claim 20, wherein said polymer is a copolymer of at least one other monomer.

26. Ink jet recording material according to claim 20, wherein said ink receiving layer further comprises a pigment.

27. Ink jet recording material according to claim 26, wherein said pigment is an inorganic pigment.

28. Ink jet recording material according to claim 27, wherein said inorganic pigment is chosen from the group consisting of aluminium oxide, boehmite, pseudo-boehmite, gibbsite, bayerite, aluminium hydroxide, silica, clay, calcium carbonate, zirconia and mixed inorganic oxides/hydroxides.

29. Ink jet recording material according to claim 20, wherein said ink receiving layer further contains a hardener capable of crosslinking said polymer.

30. Ink jet recording material according to claim 29, wherein said hardener is boric acid.

31. Ink jet recording material according to claim 20, wherein $L_2$ is selected from the group consisting of:

$—CH_2CH_2—$; $—CH_2CH_2CH_2—$; $—CH_2CH(CH_3)—$; $—CH(CH_3)CH_2—$; $—CH_2CH(CH_2OH)—$; $—CH(CH_2OH)CH_2—$; $—CH═CH—$; $—CH═CHCH_2—$; $—C═CCH_2—$; $—CH_2CH═CH—$; $—CH_2C═C—$; $—CH═C(CH_3)—$ and $—C(CH_3)═CH—$.

32. An ink jet recording material comprising a support and at least one ink receiving layer containing a water-soluble or water-dispersible polymer, wherein said polymer comprises a repeating monomeric unit having a moiety capable of chelating boric acid by means of at least one nitrogen containing functional group and at least one hydroxyl group thereby forming a five- or six-membered ring wherein said monomeric unit is represented by a monomeric unit selected from the group consisting of:

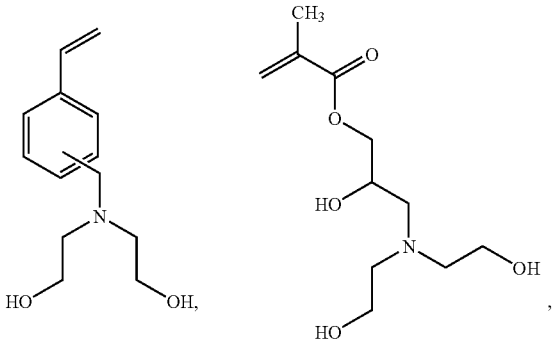

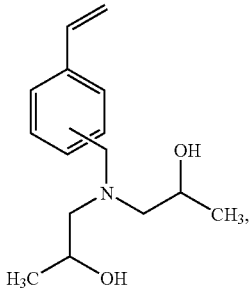

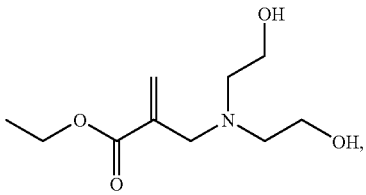

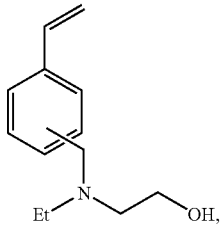

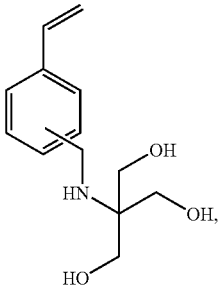

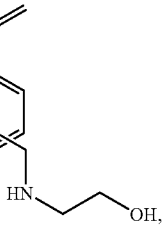

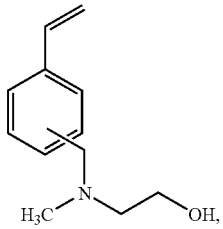

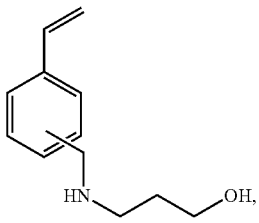

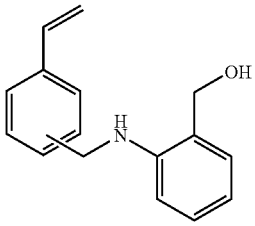

-continued
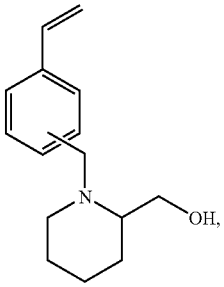
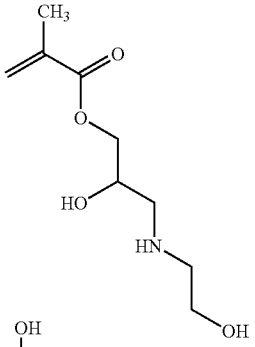
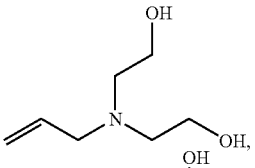
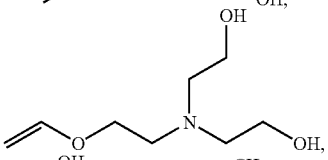
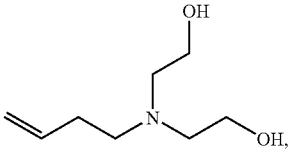
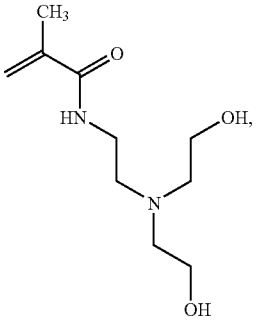
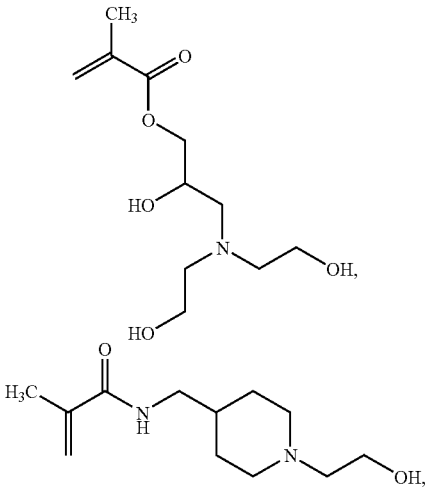
-continued
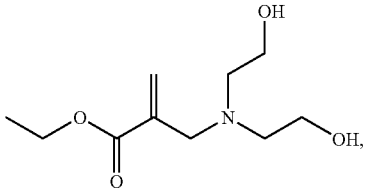
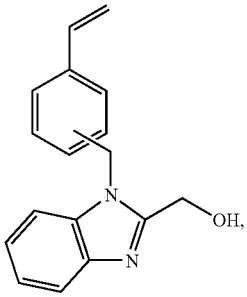
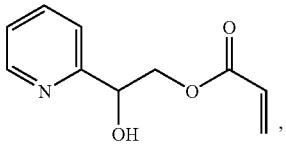
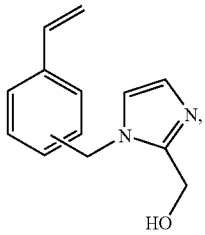
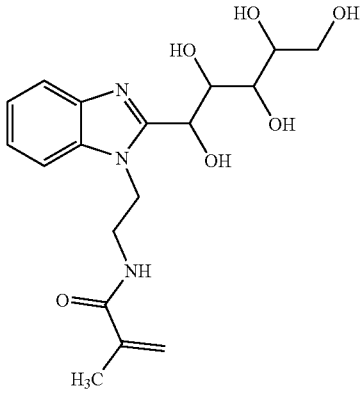
and
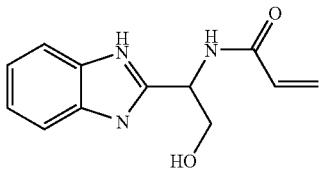
.
* * * * *